US008662545B2

(12) United States Patent
Taga

(10) Patent No.: US 8,662,545 B2
(45) Date of Patent: Mar. 4, 2014

(54) VEHICLE DOOR LATCH APPARATUS

(75) Inventor: Takao Taga, Kanagawa-ken (JP)

(73) Assignee: Mitsui Kinzoku Act Corporation, Kanagawa (JP)

( * ) Notice: Subject to any disclaimer, the term of this patent is extended or adjusted under 35 U.S.C. 154(b) by 403 days.

(21) Appl. No.: 12/656,435

(22) Filed: Jan. 29, 2010

(65) Prior Publication Data

US 2010/0207401 A1 Aug. 19, 2010

(30) Foreign Application Priority Data

Feb. 19, 2009 (JP) ..... 2009-036450

(51) Int. Cl.
*E05C 3/06* (2006.01)
*E05C 3/16* (2006.01)

(52) U.S. Cl.
USPC ..... 292/216; 292/201; 292/DIG. 23

(58) Field of Classification Search
USPC ..... 292/216, DIG. 23, 201, 337; 70/264
See application file for complete search history.

(56) References Cited

U.S. PATENT DOCUMENTS 3,601,883 A * 8/1971 Arlauskas et al. ..... 29/404
4,538,845 A * 9/1985 Yamada ..... 292/216
4,913,477 A * 4/1990 Watanuki et al. ..... 292/216
5,000,495 A * 3/1991 Wolfgang et al. ..... 292/216
5,350,206 A * 9/1994 Akahori et al. ..... 292/336.3
5,709,420 A * 1/1998 Umino ..... 292/216
5,899,508 A * 5/1999 Cetnar et al. ..... 292/216
6,053,543 A * 4/2000 Arabia et al. ..... 292/201
6,168,215 B1 * 1/2001 Kodama et al. ..... 292/201
6,273,480 B1 * 8/2001 Burton ..... 292/340
6,328,353 B1 * 12/2001 Barczynski et al. ..... 292/216
6,497,436 B1 * 12/2002 DeBlock et al. ..... 292/216
6,575,506 B2 * 6/2003 Hayakawa et al. ..... 292/216
6,634,682 B2 * 10/2003 Fukunaga et al. ..... 292/216
6,672,634 B2 * 1/2004 Burton ..... 292/340
6,679,532 B2 * 1/2004 Inoue ..... 292/216
6,848,727 B1 * 2/2005 Cetnar et al. ..... 292/201

(Continued)

FOREIGN PATENT DOCUMENTS

JP 07-269555 10/1995
JP 11-293985 10/1999
JP 2005-282222 10/2005
JP 3758966 B2 1/2006

OTHER PUBLICATIONS

Notification of Reason for Rejection in JP Appln No. 2009-036450 dated Feb. 15, 2011.

*Primary Examiner* — Carlos Lugo
*Assistant Examiner* — Alyson M Merlino
(74) *Attorney, Agent, or Firm* — Foley & Lardner LLP

(57) ABSTRACT

A vehicle door latch apparatus includes a meshing portion assembly and an operating portion assembly. The meshing portion assembly includes: a latch; and a pawl engaging with the latch for preventing a rotation of the latch. The operating portion assembly includes: a casing including a shaft portion and a slit; and an operation lever pivotally supported on the shaft portion and including a shaft hole. The slit is provided in a wall portion of the casing at right angles to a rotating plane of the operation lever. The operation lever enters the slit in a waiting position. A movement of the operation lever in a direction of a rotating axis thereof is prevented by loosely fitting the shaft hole on the shaft portion and by entering the operation lever to the slit in a state where the meshing portion assembly is not attached to the operating portion assembly.

16 Claims, 7 Drawing Sheets

(56) References Cited

U.S. PATENT DOCUMENTS

| | | | | |
|---|---|---|---|---|
| 6,951,355 | B2 * | 10/2005 | Hayakawa et al. | 292/201 |
| 7,063,360 | B2 * | 6/2006 | Fukunaga et al. | 292/216 |
| 7,380,845 | B2 * | 6/2008 | Suzumura et al. | 292/216 |
| 7,621,571 | B2 * | 11/2009 | Umino | 292/216 |
| 7,770,945 | B2 * | 8/2010 | Umino | 292/201 |
| 7,815,231 | B2 * | 10/2010 | Suzumura et al. | 292/216 |
| 2002/0056996 | A1 | 5/2002 | Fukunaga et al. | |
| 2005/0218662 | A1 * | 10/2005 | Umino | 292/216 |
| 2005/0218669 | A1 * | 10/2005 | Johnson et al. | 292/340 |
| 2007/0075552 | A1 * | 4/2007 | Hayakawa et al. | 292/216 |
| 2007/0210587 | A1 * | 9/2007 | Inoue et al. | 292/201 |

* cited by examiner

VEHICLE DOOR LATCH APPARATUS

This application claims priority from Japanese Patent Application No. 2009-036450 filed on Feb. 19, 2009, the entire subject matter of which is incorporated herein by reference.

BACKGROUND OF THE INVENTION

1. Field of the Invention

The present invention relates to a vehicle door latch apparatus.

2. Description of the Related Art

There has been proposed a related art door latch apparatus, which is made by attaching a meshing portion assembly to a operating portion assembly so that the meshing portion assembly and the operating portion assembly are made into an integral unit (refer to Japanese Patent No. 3758966, for example). Here, the meshing portion assembly includes a latch that is capable of being brought into engagement with a striker on a vehicle body side and a pawl that is capable of being brought into engagement with the latch. The operating portion assembly includes an operation lever that enables the pawl to operate and a casing that supports the operation lever.

In the related art vehicle door latch apparatus, the meshing portion assembly is configured to be prevented from being dislocated from the operating portion assembly by causing the meshing portion assembly to slide to fit in the casing so that a locking groove provided in a sub-base plate of the meshing portion assembly is brought into engagement with a locking shaft portion of a resin support pin that pivotally supports the operation lever on the casing. That is, the resin support pin, which pivotally supports the operation lever on the casing, is necessary prior to the integration of the meshing portion assembly and the operating portion assembly. Thus, the number of components involved therein is increased, and thus production cost of the related art door latch apparatus is increased.

SUMMARY OF THE INVENTION

The invention has been made in view of the problems. An object of the invention is to provide a vehicle door latch apparatus that enables a reduction in the number of components involved by enabling an operation lever to be attached to a casing temporarily without using a support pin.

According to a first aspect of the invention, there is provided a vehicle door latch apparatus comprising: a meshing portion assembly comprising: a latch that is brought into engagement with a striker on a vehicle body side; and a pawl that is brought into engagement with the latch so as to prevent a rotation of the latch; and an operating portion assembly comprising: a casing, which is fixed to the meshing portion assembly, and which comprises a shaft portion and a slit; and an operation lever, which is pivotally supported on the shaft portion so as to be rotatable between a waiting position and an operating position for operating the pawl, and which comprises a shaft hole, wherein the slit is provided in a wall portion of the casing at right angles to a rotating plane of the operation lever so that the operation lever enters the slit when the operation lever is in the waiting position, wherein the meshing portion assembly is attachable to the operating portion assembly to form an integral unit, and wherein a movement of the operation lever in a direction of a rotating axis thereof is prevented by loosely fitting the shaft hole of the operation lever on the shaft portion of the casing and by entering the operation lever to the slit in a state where the meshing portion assembly is not attached to the operating portion assembly.

According thereto, the operation lever can temporarily be attached to the shaft portion of the casing in advance in a step prior to the integration of the meshing portion assembly and the operating portion assembly, which obviates the necessity of a resin support pin which has been required in the related art. Therefore, it becomes possible to reduce the number of components involved therein.

According to a second aspect of the invention, in the vehicle door latch apparatus, wherein a cylindrical burring is provided on a circumference of the shaft hole so as to project in a direction of an axis of the shaft hole.

According thereto, the inclination of the operation lever relative to the rotating plane can be suppressed. Therefore, it becomes possible to attach temporarily the operation lever to the shaft portion of the casing in an ensured fashion.

According to a third aspect of the invention, in the vehicle door latch apparatus, wherein a cylindrical portion is provided on a circumference of the shaft portion, and wherein the burring is loosely fitted in a gap between an outer circumferential surface of the shaft portion and an inner circumferential surface of the cylindrical portion.

According thereto, the operation lever can temporarily be attached to the shaft portion of the casing in an ensured fashion.

According to a fourth aspect of the invention, in the vehicle door latch apparatus, wherein a fastening portion is provided on the meshing portion assembly so as to face the shaft portion of the casing, and wherein the fastening portion is fastened to a distal end of the shaft portion with a screw so that the operation lever is provided between the fastening portion and the casing.

According thereto, the operation lever can pivotally be supported on the shaft portion of the casing in an ensured fashion.

According to a fifth aspect of the invention, in the vehicle door latch apparatus, wherein the operating lever comprises: a first end portion; a bead, which is provided between the shaft hole and the first end portion, and which enters the slit when the operation lever is in the waiting position; and a second end portion.

According to a sixth aspect of the invention, in the vehicle door latch apparatus, the casing further comprises a restricting portion, with which the outside lever closer to the second end portion is brought into abutment when the outside lever is inclined relative to the rotating plane.

According to a seventh aspect of the invention, in the vehicle door latch apparatus, wherein the meshing portion assembly further comprises a first engaging portion that engages a second engaging portion of the operating portion assembly to form the integral unit.

According to the invention, in the step prior to the integration of the meshing portion assembly and the operating portion assembly, the operation lever can temporarily be attached to the casing by fitting loosely the shaft hole in the operation lever on the shaft portion of the casing and by causing a rotating portion of the operation lever to enter the slit. Therefore, the necessity of the resin support pin, which has been required in the related art, can be reduced. Accordingly, it becomes possible to reduce the number of components involved therein.

DETAILED DESCRIPTION OF THE PREFERRED EMBODIMENTS

Hereinafter, an embodiment of the invention will be described with reference to the drawings. In the following description, in FIGS. 1 and 2, a left-hand side denotes an "inner side" of a vehicle and a right-hand side denotes an "outer side" of the vehicle. In FIG. 2, a left-hand side denotes a "front" of the vehicle and a right-hand side denotes a "rear" of the vehicle.

A door latch apparatus 1 is attached in an interior of a door of a vehicle. The door latch apparatus 1 includes a meshing portion assembly 2 for holding the door in a closed condition by being brought into engagement with a striker (whose illustration is omitted) on a vehicle body side and an operating portion assembly 3 for operating the meshing portion assembly 2. The door latch apparatus 1 is made by attaching the meshing portion assembly 2 to the operating portion assembly 3 so that the meshing portion assembly 2 and the operating portion assembly 3 are made into an integral unit.

Figure 5:
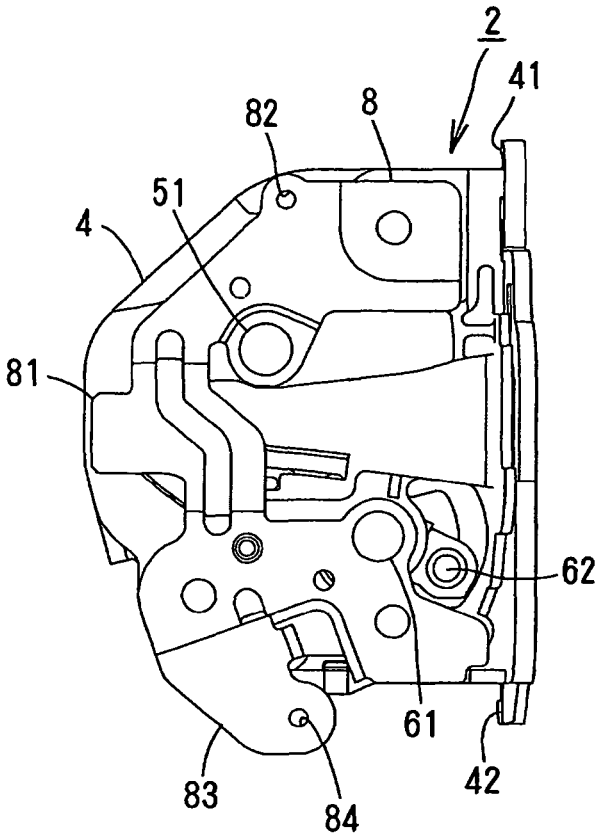
FIG. 5 is a rear view of the meshing portion assembly.

The meshing portion assembly 2 includes: a body 4, which is made from a synthetic resin, and which is fixed to the door; a latch 5, which is pivotally supported within the body 4 by a pivot 51, and which is capable of being brought into engagement with the striker on the vehicle body side; a pawl 6, which is pivotally supported within the body 4 by a pivot 61, and which is capable of being brought into engagement with the latch 5; a pawl pin 62 (refer to FIG. 5), which is provided on a rear side (a front side in such a state that the door latch apparatus 1 is attached to the door) of the body 4, and which is provided integrally with the pawl 6; a metallic cover plate 7 that closes a front side (i.e., a rear side in such a state that the door latch apparatus 1 is attached to the door) of the body 4; and a metallic back plate 8 that is fixed to the rear side of the body 4.

Figure 1:
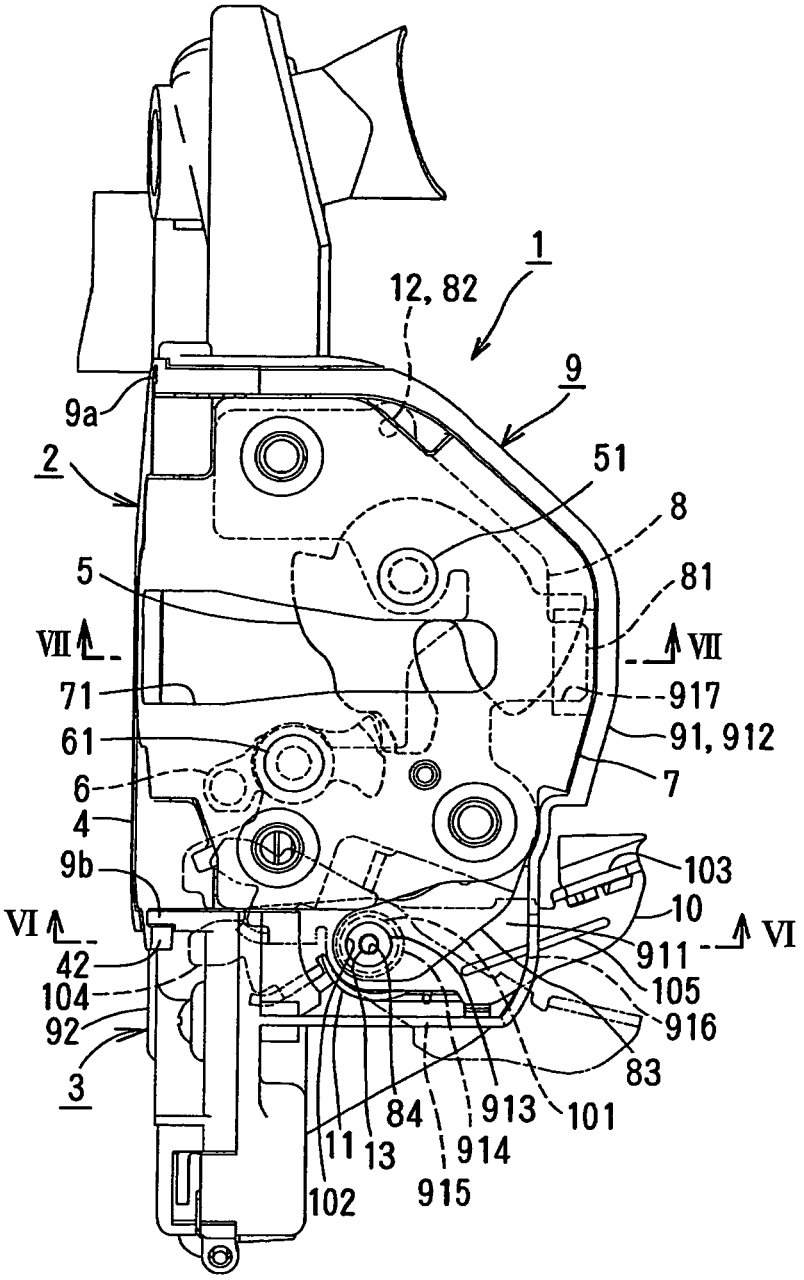
FIG. 1 is a front view of a door latch apparatus according to the invention.
Figure 2:
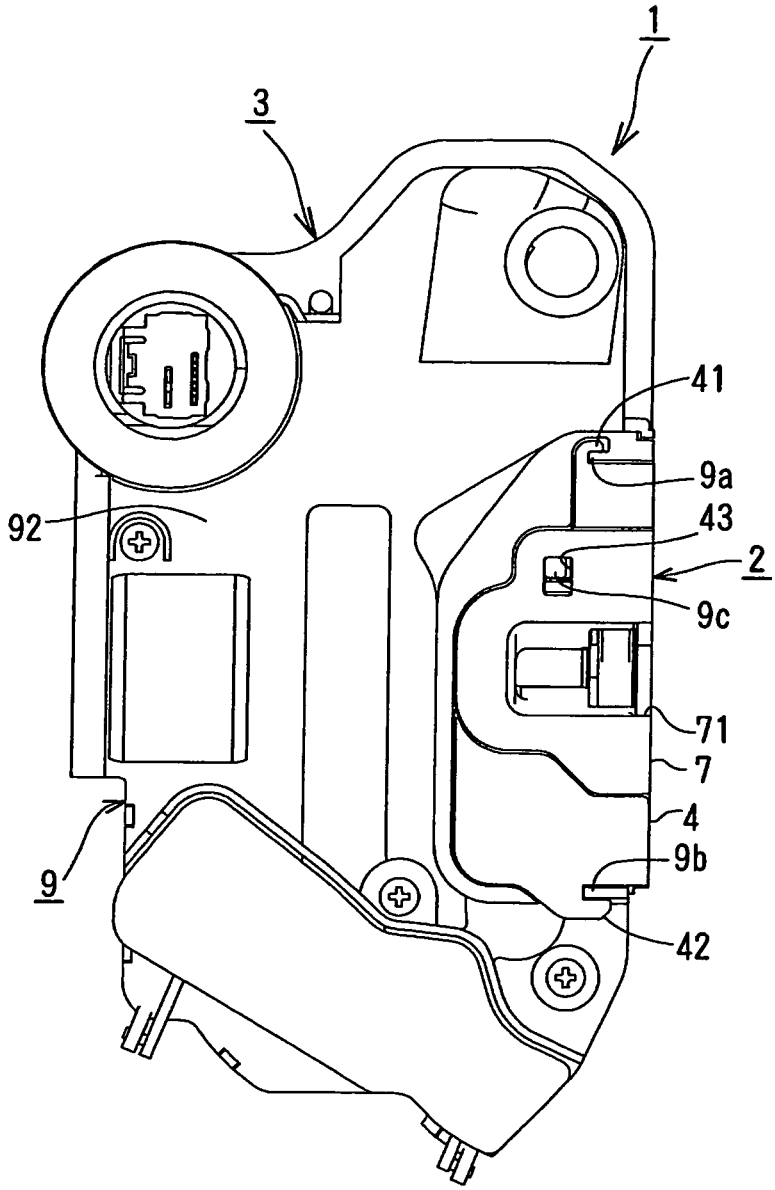
FIG. 2 is a right side view of the door latch apparatus in FIG. 1.
Figure 3:
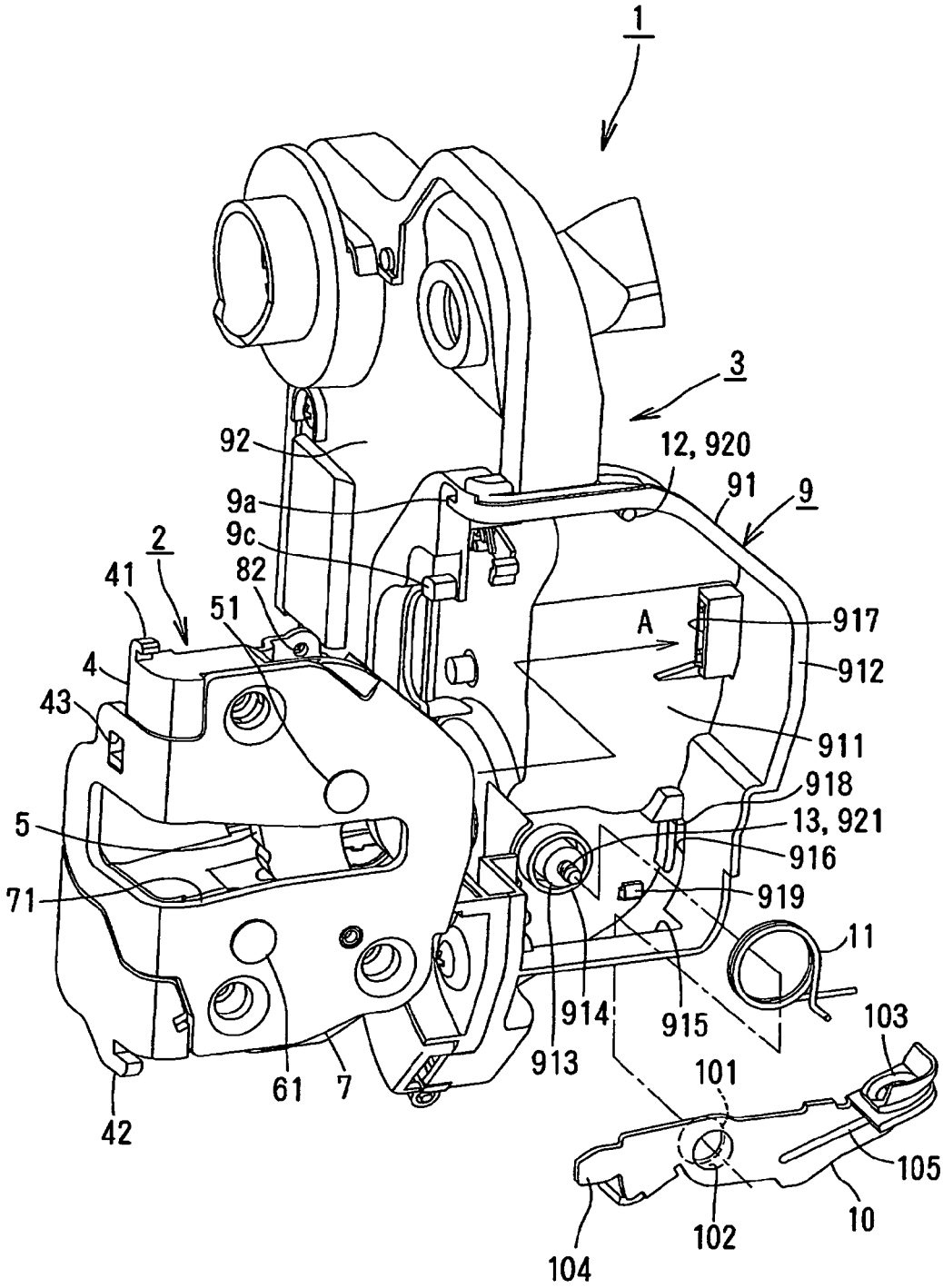
FIG. 3 is an exploded perspective view of the door latch apparatus.

When the door is closed, the striker enters a striker entry groove 71 to thereby be brought into engagement with the latch 5, and the pawl 6 engages the latch 5 so as to prevent a rotation of the latch 5 in an opening direction (a clockwise direction in FIGS. 1, 3). Therefore, the door is held in a closed condition.

The operating portion assembly 3 includes: a casing 9, which is made from a synthetic resin, and which is fixed to the rear side of the body 4 via the back plate 8; various operating levers that are incorporated within the casing 9; linkage levers (not shown); and a motor (not shown).

The various operation levers incorporated within the casing 9 include: an outside lever 10 that is connected to an outside handle, which is provided on the door at an outer side of the vehicle, and which is operated to open the door, via an operating force transmitting member such as a rod or a cable; an inside lever (not shown) that is linked with an inside handle provided on the door at an inner side of the vehicle for opening the door; a locking lever (not shown) that is linked with a lock knob provided on the inner side of the door for locking and unlocking the door; and a key lever (not shown) that is linked with a key cylinder. One of the linkage levers is a sub-lever that is linked with the locking lever so as to move between an unlocking position and a locking position. Incidentally, since the embodiment will be described in which the invention is applied to the outside lever 10, operation levers other than the outside lever 10 and the linkage levers will not be illustrated. However, the invention is not limited only to the outside lever 10. The invention may be applied to the other operation levers.

Upper and lower claw portions 41, 42 and an engagement hole 43 are provided on the body 4 of the meshing portion assembly 2. Upper and lower claw portions 9*a*, 9*b* and an engaging projecting portion 9*c* are provided on a side surface of the casing 9 at a side facing the inner side of the vehicle. The upper and lower claw portions 41, 42 and the engagement hole 43 are fittable into an on the upper and lower claw portions 9*a*, 9*b* and the engaging projecting portion 9*c* vertically and in a front-rear direction (i.e., a separating direction), respectively (see FIG. 3, for example).

Figure 7:
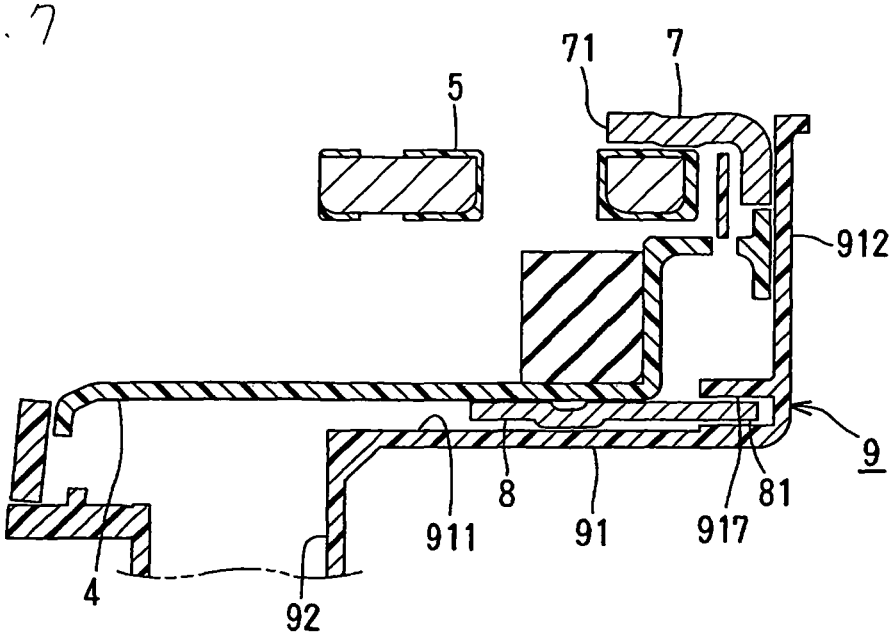
FIG. 7 is a sectional view taken along the line VII-VII in FIG. 1.

An engaging projecting portion 81 is provided at a substantially central portion in a vertical direction of the back plate 8. The engaging projecting portion 81 has a tongue shape and projects in a direction of an outside of the vehicle. As shown mainly in FIG. 7, the engaging projecting portion 81 fits in a fitting groove 917 that is provided on an inner surface (i.e., a surface facing the back plate 8) of the casing 9 of the operating portion assembly 3 vertically and in the front-rear direction.

In the integrated unit of the meshing portion assembly 2 and the operating portion assembly 3, portions where the claw portions 41, 42, the engagement hole 43 and the engaging projecting portion 81 (one example of a first engaging portion) of the meshing portion assembly 2 and the claw portions 9*a*, 9*b*, the engaging projecting portion 9*c* and the engagement groove 917 (one example of a second engaging portion) are fitted into each other bear a separation load (i.e., a load acting in a direction in which the casing 9 is separated to the front from the meshing portion assembly 2) between the meshing portion assembly 2 and the operating portion assembly 3. According thereto, integration of the meshing portion assembly 2 and the operating portion assembly 3 can be made strong and rigid. Incidentally, the claw portions 41, 42, the engagement hole 43 and the engaging projecting portion 81 of the meshing portion assembly 2

In order to make stronger and more rigid the integration of the meshing portion assembly 2 and the operating portion assembly 3, the casing 9 is fixedly fastened to the back plate 8 at upper and lower portions thereof with screws 12, 13 that are oriented to the rear. The upper screw 12 is put through a hole 920 provided in a base portion 911 of the casing 9 so as to be screwed into an internally threaded screw hole 82 provided in an upper portion of the back plate 8. In addition, the lower screw 13 is put through a hole 921 that extends in an axial direction through a center of a shaft portion 913 (i.e., a shaft for pivotally supporting the outside lever 10) that is provided integrally on the casing 9 so as to be screwed into an internally threaded screw hole 84 provided in a fastening portion at a lower portion of the back plate 8.

The casing 9 includes a first casing 91 and a second casing 92. The first casing 91 covers a rear side of the meshing portion assembly 2 in such a state that the meshing portion assembly 2 and the operating portion assembly 3 are made into the integral unit. The second casing 92 is at right angles to the first casing 91. The other operation levers than the outside lever 10 and the linkage levers are incorporated within the second casing 92.

The first casing 91 faces a rear side of the body 4 of the meshing portion assembly 2 via the back plate 8. The first casing 91 includes the base portion 911, on which the shaft portion 913 for pivotally supporting the outside lever 10 is formed integrally, and a wall portion 912 that is provided along an outer circumference of the base portion 911 so as to surround an outer circumferential surface of the body 4.

The shaft portion 913 is provided at the base portion 911 of the first casing 91 to project therefrom so as to face the internally threaded screw hole 84 in the back plate 8. As shown mainly in FIG. 6, a distal end of the shaft portion 913 is fixedly fastened to the fastening portion 83 of the back plate 8 by the screw 13 that is put through the hole 921 provided in the center of the shaft portion 913.

The outside lever 10 includes a shaft hole 102, which is formed by a cylindrical burring 101 provided at a substantially central portion of the outside lever 10, and which is loosely fitted on the shaft portion 913 so as to rotate thereabout. As shown mainly in FIG. 6, the outside lever 10 is provided between a distal end of a cylindrical portion 914 that is provided on the first casing 91 and the fastening portion 83 of the back plate 8. Further, the outside lever 10 is pressed in awaiting direction (i.e., a counterclockwise direction in FIGS. 1, 3) by a spring 11 that is wound around an outer circumference of the cylindrical portion 914. When the outside lever 10 is not in operation, the outside lever 10 abuts a stopper 918 that is provided on the first casing 91 and stops in a waiting position (i.e., a position shown in FIGS. 1, 3).

A connecting portion 103 is provided at one end portion (one example of a first end portion), which is provided at a portion projecting from the casing 9, of the outside lever 10. The connecting portion 103 is connected to an end portion of a rod or a cable that can transmit an operating force exerted on the outside handle. The other end portion (one example of a second end portion) 104 of the outside lever 10 is an end portion provided within the casing 9. The other end portion 104 is linked so as to actuate a linkage lever provided in the second casing 92. A bead 105 is provided on a rotating portion, that is, a portion of the outside lever 10 which lies between the shaft hole 102 and the connecting portion 103. The bead 105 is provided so as to extend in a radial direction of the rotating portion.

When the outside handle is operated to open the door, the outside lever 10 rotates from the waiting position shown by solid lines in FIG. 1 in a clockwise direction through a predetermined angle against a pressing force of the spring 11 to an operating position shown by chain double-dashed lines in FIG. 1. As this occurs, when the lock knob is in the unlocking condition and the locking lever and the linkage lever are in the unlocking position, the linkage lever linked with the outside lever 10 operates in conjunction with the operation of the outside lever 10 so as to actuate the pawl pin 62 to release the engagement between the pawl 6 and the latch 5. Therefore, the door can be opened. In contrast, when the lock knob is in the locking condition and the locking lever and the linkage lever are in the locking position, even in the event that the linkage lever operates in conjunction with the operation of the outside lever 10, the linkage lever is unable to actuate the pawl pin 62. Thus, the door cannot be opened.

The cylindrical portion 914 is provided on a circumference of the shaft portion 913 of the first casing. The cylindrical portion 914 is formed such that an axial length thereof is slightly shorter than an axial length of the shaft portion 913 (see FIG. 3, for example). The burring 101 of the outside lever 10 is loosely fitted between an outer circumferential surface of the shaft portion 913 and an inner circumferential surface of the cylindrical portion 914 so as to rotate thereat (see FIG. 6, for example). By this configuration, in combination with the loose fitting of the shaft hole 102 formed in the outside lever 10 by the burring 101 on the shaft portion 913, an inclination (i.e., see directions indicated by arrows in FIG. 6) of the outside lever 10 relative to a rotating plane (i.e., a plane which is at right angles to an axial direction of the shaft portion 913) of the outside lever 10 can be suppressed.

In the wall portion 912, which lies around the shaft portion 913, and which is at right angles to the rotating plane of the outside lever 10, an opening portion 915 and a slit 916 are provided so as to extend along a rotating direction of the outside lever (see FIG. 3, for example).

The opening portion 915 is formed to have a size that enables the outside lever 10 to be inserted into the casing 9 from the other end portion 104 thereof when the outside lever 10 is mounted within the casing (which will be described later) in a step prior to the integration of the meshing portion assembly 2 and the operating portion assembly 3.

Figure 6:
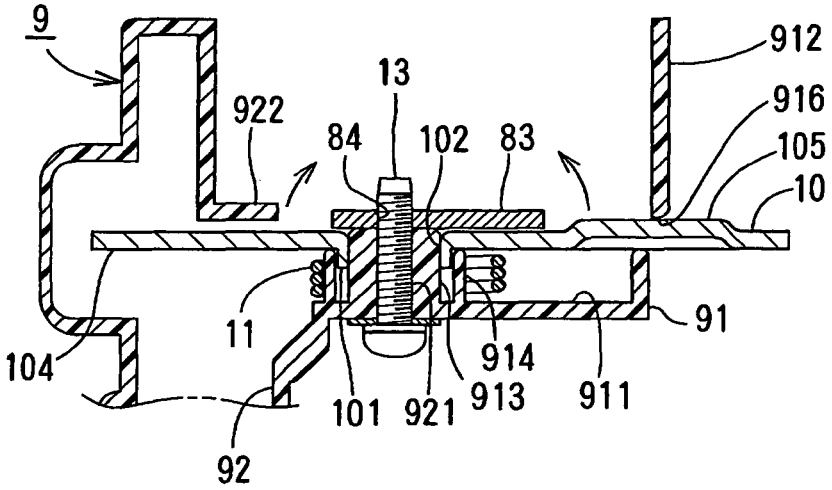
FIG. 6 is a sectional view taken along the line VI-VI in FIG. 1.

The slit 916 is provided so as to be continued from an outer side of the opening portion 915 facing the outer side of the vehicle. The slit 916 is provided in a position where the rotating portion of the outside lever 10 can enter the slit 916 when the outside lever 10 stays in an operating range (i.e., lying between the waiting position shown by the solid lines and the operating position shown by the chain double-dashed lines in FIG. 1). An opening width of the slit 916 is formed to be slightly larger than the sub of a thickness of the outside lever 10 and a height (i.e., a projecting amount) of the bead 105. A length (i.e., a length which follows the rotating direction of the outside lever 10) of the slit 916 is set such that the bead 105 is not dislocated from the slit 916 even when the outside lever 10 moves to the operating position According thereto, in a state where both side surfaces of the rotating portion of the outside lever 10, one side of which has the bead 105, enter the slit 916, both side surfaces of the outside lever 10 are held within the slit 916 with a slight play. Therefore, the outside lever 10 is prevented from moving in the direction of a rotating axis thereof. That is, the outside lever 10 is prevented from moving in a direction, in which the shaft hole 102 is dislocated from the shaft portion 913. Thus, even if the meshing portion assembly 2 and the operating portion assembly 3 have not yet been made into an integral unit, that is, even if the fastening portion 83 of the back plate 8 has not yet been fixedly fastened to the distal end of the shaft portion 913, the outside lever 10 is not easily dislocated from the shaft portion 913. Consequently, the outside lever 10 can temporarily be attached to the casing 9. Further, in a state where the meshing portion assembly 2 and the operating portion assembly 3 are made into an integral unit, the rotating portion of the outside lever 10 having the bead 105 slides within the slit 916, and therefore, the outside lever 10 can rotate smoothly. Still further, as shown in FIG. 6, as for the other end portion 104 side of the outside lever 10, a restricting portion 922, with which the outside lever 10 closer to the other end portion 104 can be brought into abutment when the outside lever 10 is inclined relative to the rotating plane thereof, is provided on the casing 9. By providing the restricting portion 922, even if the fastening portion 83 of the back plate 8 has not yet been fixedly fastened to the distal end of the shaft portion 913, the dislocation of the outside lever 10, which is being temporarily attached to the casing 9, from the shaft portion 913 can be prevented more reliably.

Next, a working process of temporarily attaching the outside lever 10 to the casing and a working process of integrating the meshing portion assembly 2 and the operating portion assembly 3 together will be described.

Firstly, the various operation levers other than the outside lever 10, the linkage lever and the motor are incorporated in the casing and the outside lever 10 is temporarily attached to the casing 9 before the meshing portion assembly 2 and the operating portion assembly 3 are made into an integral unit.

Figure 8:
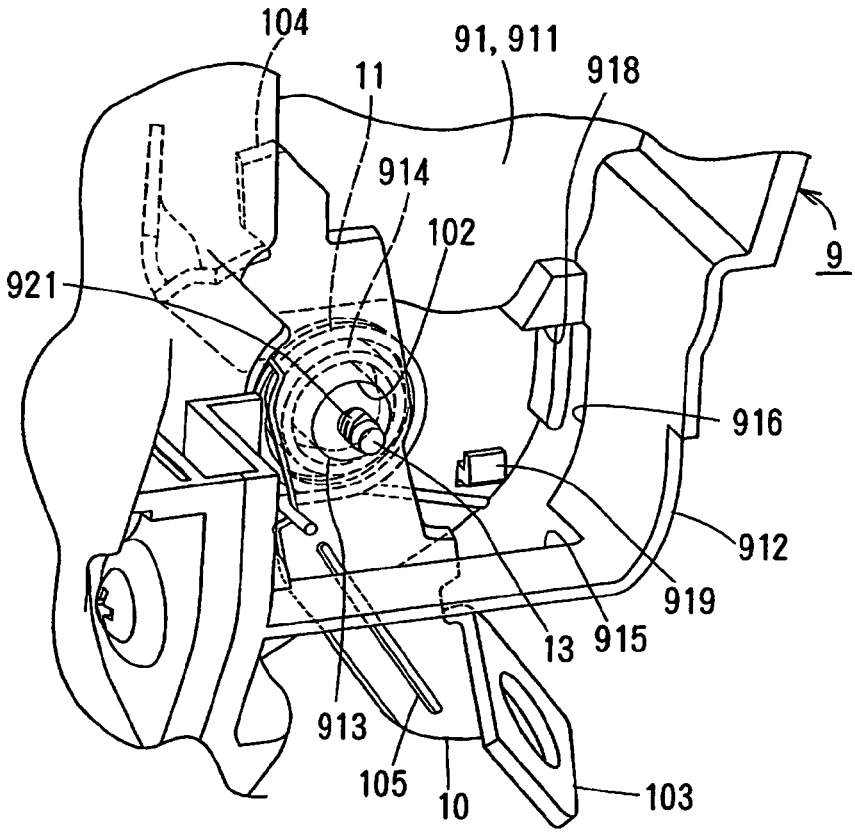
FIG. 8 is an enlarged perspective view of a main part when an outside lever is temporarily attached to a casing.
Figure 9:
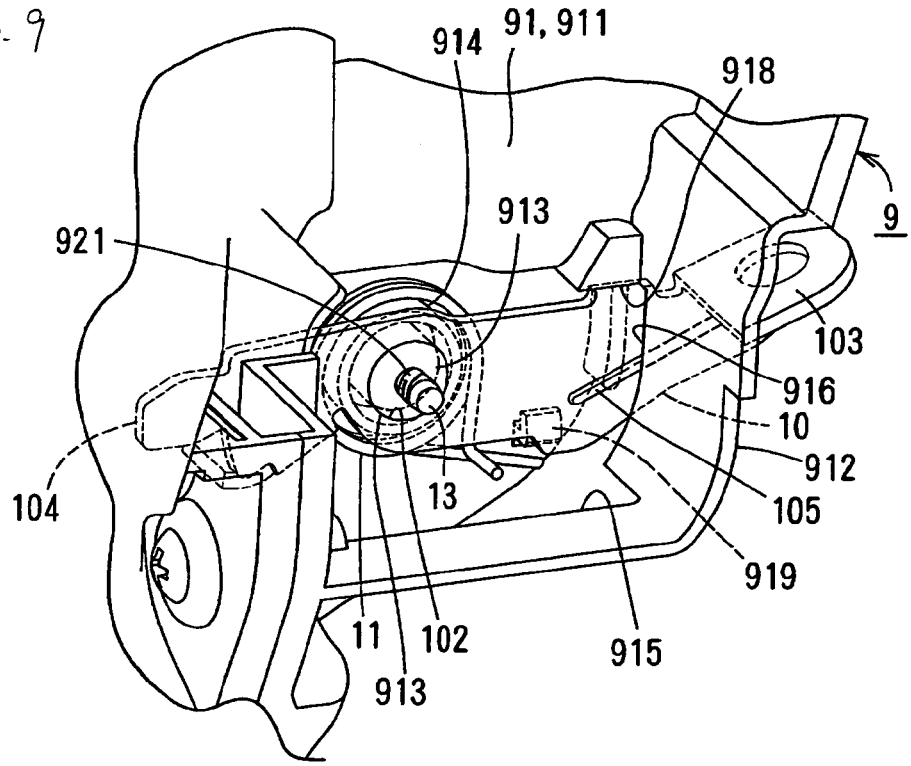
FIG. 9 is an enlarged perspective view of the main part in a state in which the outside lever has temporarily been attached to the casing.

When the outside lever 10 is temporarily attached to the casing 9, the spring 11 is wound around the cylindrical portion 914 of the casing 9 in advance, and the other end portion 104 of the outside lever 10 is inserted into the casing 9 from the opening portion 915 in the casing 9. In addition, as shown in FIG. 8, the shaft portion 913 is loosely fitted in the shaft hole 102 in the outside lever 10, and the other end portion 104 of the outside lever 10 is connected to the linkage lever. Then, in this condition, the outside lever 10 is caused to rotate in the waiting direction, and as shown in FIG. 9, the rotating portion of the outside lever 10 is caused to enter the slit 916. One end of the spring 11 is locked on a locking portion 919 provided on the casing 9, and the other end of the spring 11 is locked on the outside lever 10. According thereto, the temporary attachment of the outside lever 10 to the casing 9 is completed.

When the outside lever 10 is temporarily attached, the outside lever 10 is held in the waiting position by the pressing force of the spring 11 while both side surfaces of the rotating portion of the outside lever 10, one side of which has the bead 105, enters the slit 916 and the movement of the outside lever 10 in the direction of the rotating axis thereof is prevented. Therefore, the shaft hole 102 in the outside lever 10 is not easily dislocated from the shaft portion 913.

Figure 4:
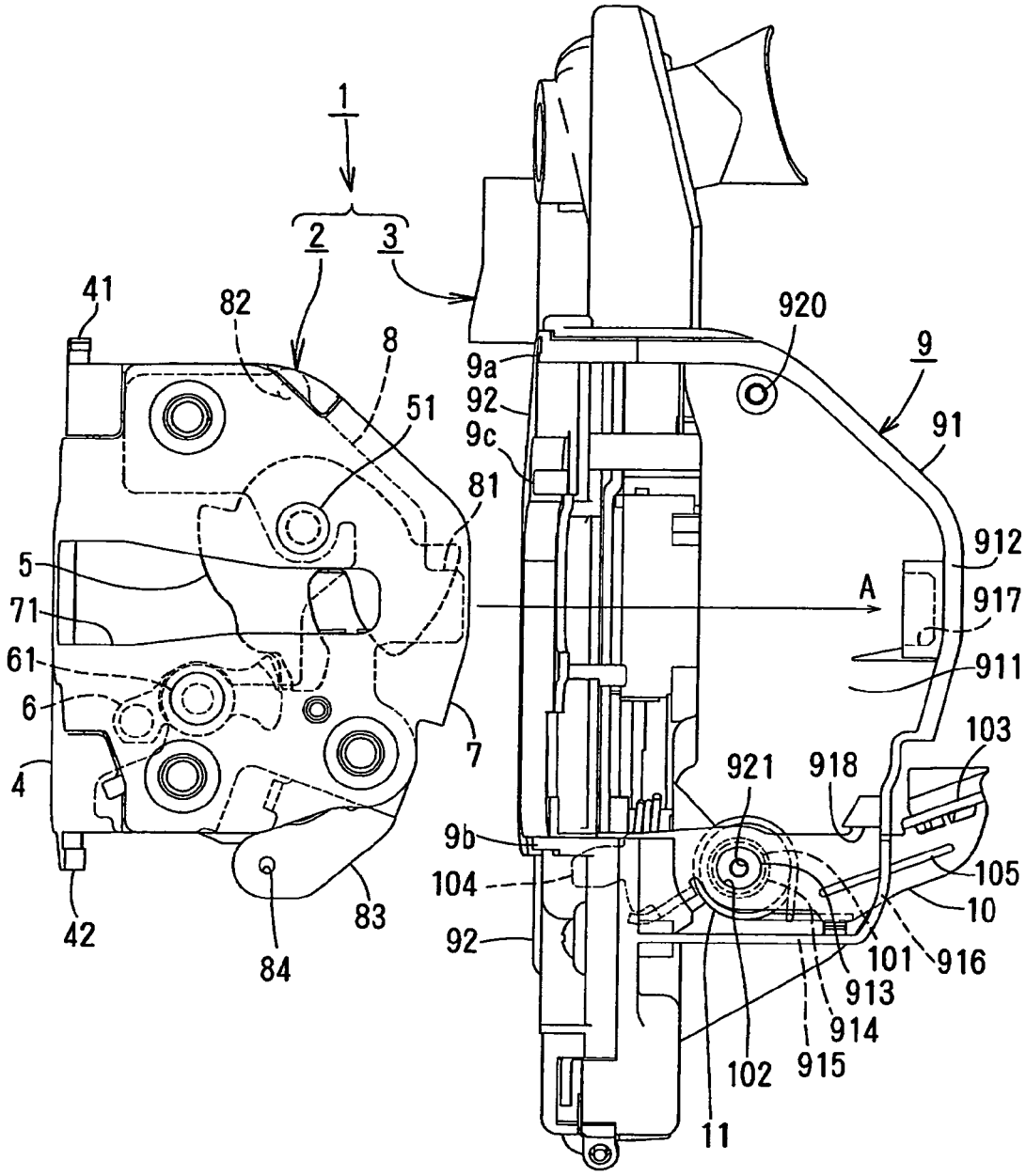
FIG. 4 is a front view of the door latch apparatus before the integration of a meshing portion assembly and an operating portion assembly.

Next, as shown in FIG. 4, the meshing portion assembly 2 is caused to slide in a direction indicated by an arrow A towards the operating portion assembly 3 into which the outside lever 10 is temporarily attached, and the upper and lower claw portions 41, 42 and the engagement hole 43 of the back body 4 and the engaging projecting portion 81 on the back plate 8 are fitted into the upper and lower claw portions 9*a*, 9*b*, the engaging projecting portion 9*c* and the engagement groove 917 of the casing 9. Finally, the upper portion of the casing 9 and the shaft portion 913 of the casing 9 are fixedly fastened to the upper portion of the back plate 8 and the fastening portion 83 of the back plate 8 with the screw 12 and the screw 13, respectively. According thereto, the integrating work of the meshing portion assembly 2 and the operating portion assembly 3 are completed.

What is claimed is:

1. A vehicle door latch apparatus comprising:

a meshing portion assembly comprising:

a latch configured to be brought into engagement with a striker on a vehicle body side; and a pawl configured to be brought into engagement with the latch so as to prevent a rotation of the latch out of engagement with the striker; and an operating portion assembly comprising:

a casing, which is fixed to the meshing portion assembly, and which comprises a shaft portion and a slit, wherein the shaft portion extends away from and is integrally formed with a base portion of the casing; and an operation lever, which is pivotally supported on the shaft portion so as to be rotatable between a waiting position and an operating position for operating the pawl to allow rotation of the latch out of engagement with the striker, and which comprises a shaft hole, wherein the casing comprises a wall portion, which is provided at a right angle to a rotating plane of the operation lever and continuously extends from a first part to a second part, which faces the first part, through a third part so as to have a substantially U-shape, wherein the slit is provided in the wall portion so that the operation lever enters a first side of the slit, which is located adjacent to the third part of the wall portion between the base portion and the third part of the wall portion, when the operation lever is in the waiting position, wherein a length of the slit is set such that at least a part of the operation lever is located within the slit and is located between the base portion and the second part of the wall portion when the operation lever moves to the operating position, wherein a cylindrical burring is provided on a circumference of the shaft hole and extends parallel to and along a portion of a length of the shaft portion, wherein a cylindrical portion is provided on a circumference of the shaft portion, and wherein the cylindrical burring is provided in a gap between an outer circumferential surface of the shaft portion and an inner circumferential surface of the cylindrical portion, wherein the meshing portion assembly is coupled to the operating portion assembly to form an integral unit, and wherein the shaft hole of the operation lever is mated with the shaft portion of the casing.

2. The vehicle door latch apparatus according to claim 1, wherein a fastening portion is provided on the meshing portion assembly so as to face the shaft portion of the casing, and wherein the fastening portion is fastened to a distal end of the shaft portion with a screw so that the operation lever is provided between the fastening portion and the casing.

3. The vehicle door latch apparatus according to claim 1, wherein the operation lever comprises:

a first end portion;

a bead, which is provided between the shaft hole and the first end portion, and which enters the first side of the slit when the operation lever is in the waiting position; and a second end portion.

4. The vehicle door latch apparatus according to claim 3, wherein the casing further comprises a restricting portion, with which the second end portion is brought into abutment when the operation lever is inclined relative to the rotating plane.

5. The vehicle door latch apparatus according to claim 1, wherein the meshing portion assembly further comprises at least one first engaging portion that engages at least one second engaging portion of the operating portion assembly to form the integral unit.

6. The vehicle door latch apparatus according to claim 1, further comprising:

a spring that applies a pressing force to the operation lever;

wherein the spring applies the pressing force in a rotational direction of the operation lever to move the operation lever into the first side of the slit and hold the operation lever at the waiting position.

7. The vehicle door latch apparatus according to claim 6, further comprising:

a cylindrical portion provided on a circumference of the shaft portion of the casing;

wherein the spring is wound around an outer circumference of the cylindrical portion.

8. The vehicle door latch apparatus according to claim 6, wherein the slit extends in the rotational direction of the operation lever so as to allow rotation of the operation lever within the slit.

9. The vehicle door latch apparatus according to claim 1, wherein the meshing portion assembly is housed in a space defined by the first part, the second part, the third part, and the base portion of the operating portion assembly and is coupled to the operating portion assembly to form the integral unit.

10. The vehicle door latch apparatus according to claim 1, wherein the pawl includes a pivot and a pin extending from a side of the pawl in a perpendicular direction that is offset from the pivot, and wherein an end portion of the operation lever moves the pin to rotate the pawl about the pivot to release the engagement between the pawl and the latch upon rotation of the operation lever to the operating position.

11. The vehicle door latch apparatus according to claim 1, further comprising a backing plate coupled to the shaft portion through a screw.

12. A vehicle door latch apparatus comprising:

a meshing portion assembly comprising:

a latch configured to be brought into engagement with a striker on a vehicle body side; and a pawl configured to be brought into engagement with the latch so as to prevent a rotation of the latch out of engagement with the striker; and an operating portion assembly comprising:

a casing, which is fixed to the meshing portion assembly, and which comprises a shaft portion and a slit, wherein the shaft portion extends away from and is integrally formed with a base portion of the casing; and an operation lever, which is pivotally supported on the shaft portion so as to be rotatable between a waiting position and an operating position for operating the pawl to allow rotation of the latch out of engagement with the striker, and which comprises a shaft hole, wherein the casing comprises a wall portion, which is provided at a right angle to a rotating plane of the operation lever and continuously extends from a first part to a second part, which faces the first part, through a third part so as to have a substantially U-shape, wherein the slit is provided in the wall portion so that the operation lever enters a first side of the slit, which is located adjacent to the third part of the wall portion between the base portion and the third part of the wall portion, when the operation lever is in the waiting position, wherein a length of the slit is set such that at least a part of the operation lever is located within the slit and is located between the base portion and the second part of the wall portion when the operation lever moves to the operating position, wherein a cylindrical burring is provided on a circumference of the shaft hole and extends parallel to and along a portion of a length of the shaft portion, wherein a backing plate is coupled to the shaft portion through a screw, wherein the backing plate is configured to support a flat side of the operation lever that is opposite the cylindrical burring, wherein the meshing portion assembly is coupled to the operating portion assembly to form an integral unit, and wherein the shaft hole of the operation lever is mated with the shaft portion of the casing.

13. The vehicle door latch apparatus according to claim 12, wherein a cylindrical portion is provided on a circumference of the shaft portion and extends from the base portion of the casing, and wherein the cylindrical burring is provided in a gap between the shaft portion and the cylindrical portion.

14. The vehicle door latch apparatus according to claim 13, further comprising a spring that applies a pressing force to the operation lever, wherein the spring is wound around the cylindrical portion, and wherein the spring is retained between the operation lever and the base portion of the casing.

15. The vehicle door latch apparatus according to claim 14, wherein the meshing portion assembly further comprises a body, wherein the body is fixed to a rear side of the backing plate.

16. A vehicle door latch apparatus comprising:

a meshing portion assembly comprising:

a latch configured to be brought into engagement with a striker on a vehicle body side; and a pawl configured to be brought into engagement with the latch so as to prevent a rotation of the latch out of engagement with the striker; and an operating portion assembly comprising:

a casing, which is fixed to the meshing portion assembly, and which comprises a shaft portion and a slit, wherein the shaft portion extends away from and is integrally formed with a base portion of the casing; and an operation lever, which is pivotally supported on the shaft portion so as to be rotatable between a waiting position and an operating position for operating the pawl to allow rotation of the latch out of engagement with the striker, and which comprises a shaft hole, the operation lever comprising:

a first end portion;

a bead, which is provided between the shaft hole and the first end portion, and which enters a first side of the slit when the operation lever is in the waiting position; and a second end portion;

wherein the casing comprises a wall portion, which is provided at a right angle to a rotating plane of the operation lever and continuously extends from a first part to a second part, which faces the first part, through a third part so as to have a substantially U-shape, wherein the casing further comprises a restricting portion, with which the second end portion is brought into abutment when the operation lever is inclined relative to the rotating plane;

wherein the slit is provided in the wall portion so that the operation lever enters the first side of the slit, which is located adjacent to the third part of the wall portion between the base portion and the third part of the wall portion, when the operation lever is in the waiting position, wherein a length of the slit is set such that at least a part of the operation lever is located within the slit and is located between the base portion and the second part of the wall portion when the operation lever moves to the operating position, wherein the meshing portion assembly is coupled to the operating portion assembly to form an integral unit, and wherein the shaft hole of the operation lever is mated with the shaft portion of the casing.

* * * * *